United States Patent [19]

Sowards et al.

[11] Patent Number: 4,761,123

[45] Date of Patent: Aug. 2, 1988

[54] LUBRICATION ARRANGEMENT, IN AN AIR COMPRESSOR

[75] Inventors: Brian D. Sowards, Mocksville; Frederick H. Emilson, Lexington, both of N.C.

[73] Assignee: Ingersoll-Rand Company, Woodcliff Lake, N.J.

[21] Appl. No.: 60,599

[22] Filed: Jun. 11, 1987

[51] Int. Cl.[4] ..... F04C 18/16; F04C 29/02; F01M 11/03

[52] U.S. Cl. ..... 418/89; 418/201; 184/6.16; 184/6.24

[58] Field of Search ..... 418/89, 102, 179, 201, 418/DIG. 1; 184/6.16, 6.24

[56] References Cited

U.S. PATENT DOCUMENTS

| | | | |
|---|---|---|---|
| 1,626,768 | 5/1927 | Vollmann | 418/DIG. 1 |
| 1,673,262 | 6/1928 | Meston et al. | 418/89 |
| 2,014,932 | 9/1935 | Hallett | 418/179 |
| 2,243,874 | 6/1941 | Lysholm | 418/201 |
| 2,474,653 | 6/1949 | Boestad | 418/201 |
| 3,820,923 | 6/1974 | Zweifel | 418/89 |
| 4,420,293 | 12/1983 | Hofmann | 418/89 |
| 4,563,138 | 1/1986 | Hofmann et al. | 418/DIG. 1 |

FOREIGN PATENT DOCUMENTS

| | | | |
|---|---|---|---|
| 1182199 | 9/1985 | U.S.S.R. | 418/201 |

*Primary Examiner*—John J. Vrablik
*Attorney, Agent, or Firm*—B. J. Murphy

[57] ABSTRACT

In the arrangement, a gear housing rotatably journals juxtaposed ends of coacting lobed, male and female rotors on a horizontal plane, and a passageway confined in the housing, on a diagonal plane which tranverses the horizontal plane, conducts oil therethrough to rotor-end bearings from an oil-admittance port at an upper end of the passageway. The rotors, then, are below the port, at a lower end of the passageway and, accordingly, the gear housing-supplied oil is scavenged into the rotors. Further, the compressor has an airend which comprises the gear housing, the latter being of aluminum, die-cast formation, having parallel, side faces, with an oil filter mounting coupled to one of the faces. A drive gear, and a therewith meshing driven gear, are supported by the housing. The driven gear is drivingly coupled to the male rotor, substantially centrally in the housing, and the female rotor is journaled in the housing, as noted, outwardly (relative to the housing) from the driven gear and male rotor.

11 Claims, 3 Drawing Sheets

LUBRICATION ARRANGEMENT, IN AN AIR COMPRESSOR

By way of explanation of the term "airend" used in this specification: air compressors are equipment "packages" which comprise a power plant (i.e., motor or engine) drivingly coupled to the air compressor unit, per se. While, evidently, it is not universal parlance in the relevant art, many involved with this technology are wont to give the power plant the nomenclature "the power end", and the air compressor unit, per se, the nomenclature "the airend". (And why the nouns "air" and "end" came to be joined in a one-word form is not known.) For the purposes of this disclosure, then, the word "airend" is to be understood as referring to the productive end of the compressor package, i.e., the powered/driven air compressor unit, per se, including the rotors, the gears therefor, bearings, lubrication means, unloaders, filters, and air-conducting ports. With that frame of reference, then, this invention pertains to arrangements, in airends of air compressors, for lubricating the gears, bearings and rotors thereof, and in particular to a lubrication arrangement, in an air compressor having an airend with coacting rotors, which accommodates for (a) aluminum diecast construction of the gear housing, (b) a generous, free-flowing air inlet, and (c) a "downhill" disposition of the rotors to provide for a scavenging of oil, from the gearbox of the airend, into the rotors.

Current trends in airend design appear to be directed toward (a) smaller size and higher speed for a given CFM, (b) aluminum die cast components, and (c) integration of parts of the airend system into the airend itself. In the conventional or state-of-the-art airend, the input shaft generally drives the male rotor. The input shaft sits more-or-less in line with the female rotor, though it may be above, below or slightly to one side. The air inlet hole is astride both rotors and in front of the gear box. The problems with adapting this construction to (a), (b), and (c) above are:

(a) high speed airends are small and gear boxes are large (due to the high gear ratios);

(b) aluminum die cast tools cannot pull out of the intricate pockets and cavities so adaptable to cast iron tooling; and (c) there is little room for more airend parts (e.g., unloader and oil filter) on the conventional construction. Also, mounting the oil filter on the airend can complicate the oil distribution lines of the air-end. A new general construction for airends has been needed to solve these problems.

It is an object of this invention to set forth a lubrication arrangement, incorporating a gear housing, in an air compressor having an airend, which offers the aforesaid new, general construction for airends.

Particularly is it an object of this invention to disclose in an air compressor having an airend with a pair of coating rotors, a lubrication arrangement therefor, comprising a gear housing; a pair of coacting rotors; said housing having means for rotatably journaling therein, on a horizontal plane, juxtaposed ends of said rotors; said housing further having a port formed therein for admitting lubricant thereinto; and said housing also having a confined passageway formed therein for conducting lubricant, which is admitted via said port, to said plane; and wherein said passageway is disposed at an inclination along a diagonal plane which trasverses said horizontal plane.

Further objects of this invention, as well as the novel features thereof, will become more apparent by reference to the following description taken in conjunction with the accompanying figures, in which.

Figure 1:
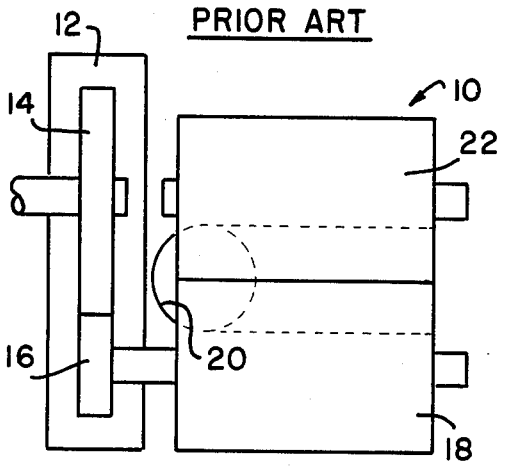
FIG. 1 is a simple, outline drawing of a prior art airend arrangement.

As shown in FIG. 1, the prior art airend 10 has a gear housing 12 which confines a drive gear 14 and a driven pinion gear 16. The pinion gear 16 is drivingly coupled to the male rotor 18, and the air inlet 20 is positioned over both male and female rotors 18 and 22, fronting the gear housing 12. An oil filter is not shown, yet it can be seen that its placement on/into the casing (not shown) for the rotors is virtually necessary. However, this causes oil distribution therefor to be rather intricate, convoluted and, accordingly, an expensive arrangement.

Figure 2:
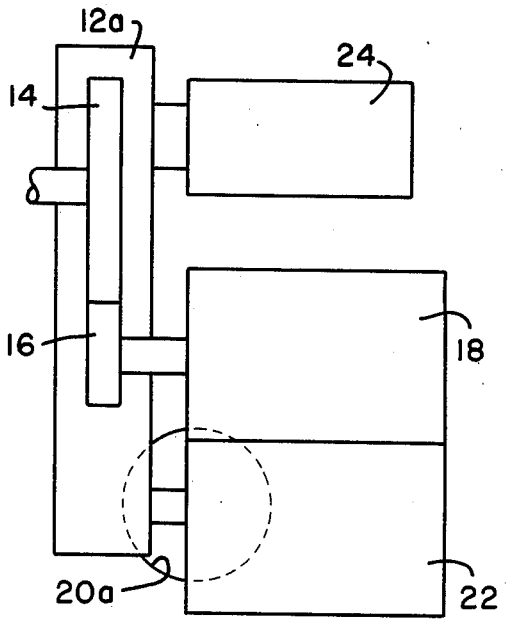
FIG. 2 is another outline drawing of an airend which accommodates therein the novel lubrication arrangement.
Figure 4:
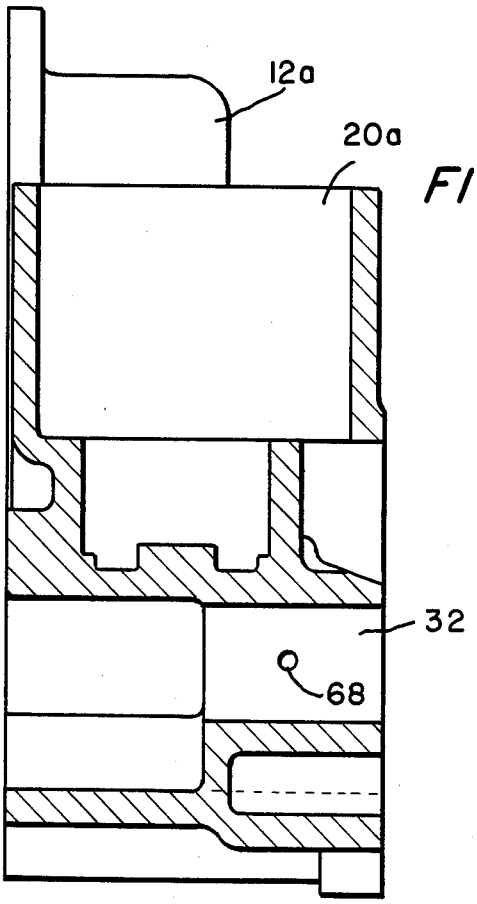
FIG. 4 is a cross-sectional view taken along section 4—4 of FIG. 3.

Our teaching is shown, only in outline form, in FIG. 2 where, for instance, the male rotor 18, and its driven, pinion gear 16, are substantially centrally journalled in the housing 12*a*, whereas the coacting female rotor 22 is well outboard, i.e., outwardly disposed (relative to the housing) from the gear 16 and rotor 18. Now there is ample room, on the face of the gear housing 12*a*, to mount the oil filter 24, and to define thereby a lubrication arrangement of an uncomplicated nature. Too, the air inlet 20*a* is positioned over the female rotor 22, and can be of generous proportions.

Figure 3:
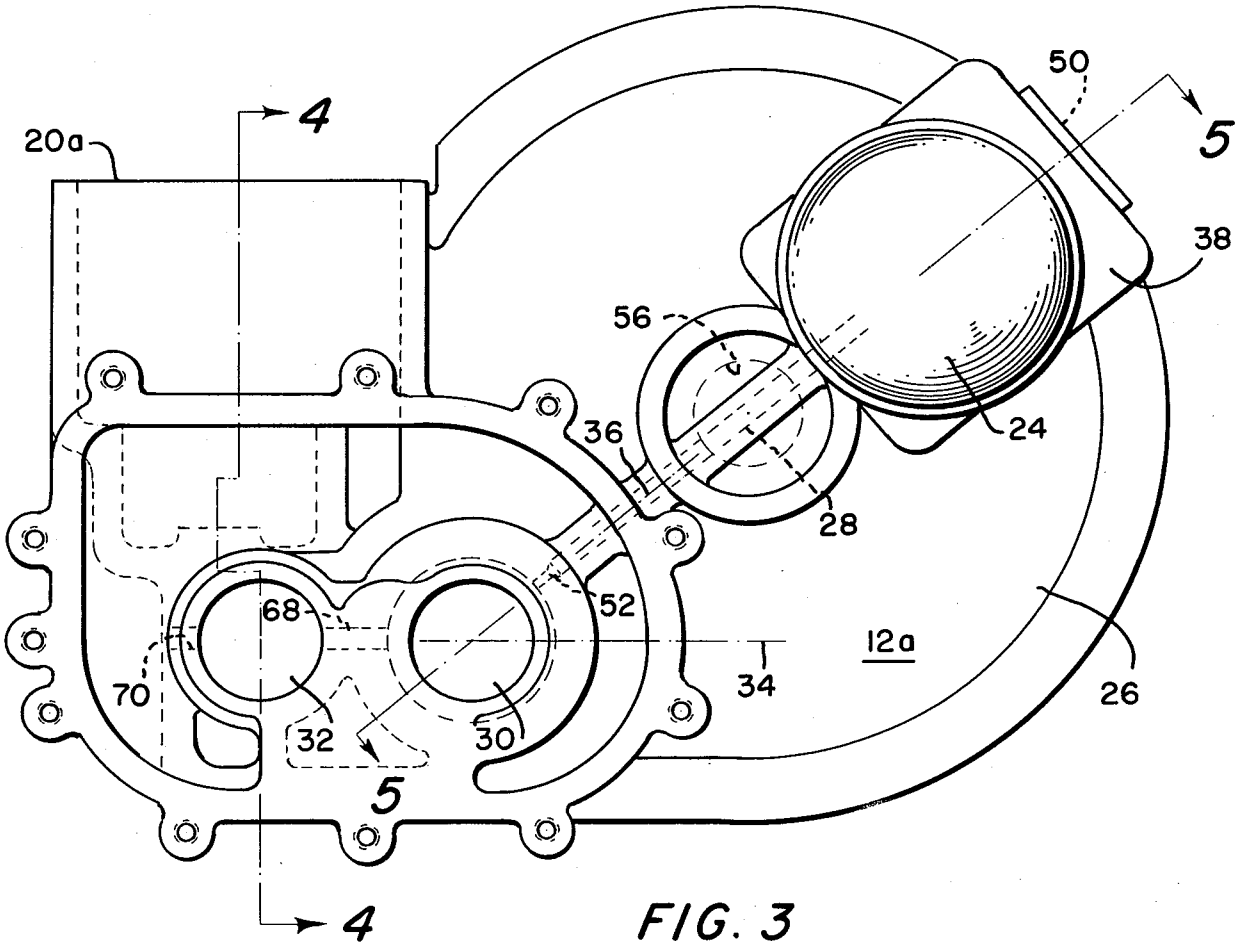
FIG. 3 is a detailed, side elevational view of the airend represented in FIG. 2.

The end view of FIG. 3 shows a detailed configuration of the gear housing 12*a*, the same being of aluminum die cast formation. On the face 26 thereof the oil filter 24 is mounted to filter oil, which is conducted along a confined passageway 28 therefrom, before it proceeds to rotor bearing journals 30 and 32.

The journals 30 and 32 have centers on a common horizontal plane 34, and the passageway 28, formed within the housing 12*a*, is on a diagonal plane 36 which traverses the horizontal plane 34 at the radial center of journal 30. Journal 30 is provided to support one end of the male rotor 18 and its pinion gear 16, and journal 32 is provided to support one end of the female rotor 22. As priorly noted, and as shown best in FIGS. 2 and 3, gear 16 and rotor 18 are substantially centrally journaled in the housing 12*a*, whereas the female rotor 22 is outboard therefrom, and to a given side thereof, being disposed in adjacency to an outermost end of the housing. The face-mounted filter 24, is disposed at substantially the opposite side (of the gear 16 and rotor 18) from the rotor 22, albeit at an inclined angle therefrom. The angled inclination facilitates oil flow from the filter 24 to the journals 30 and 32.

Figure 5:
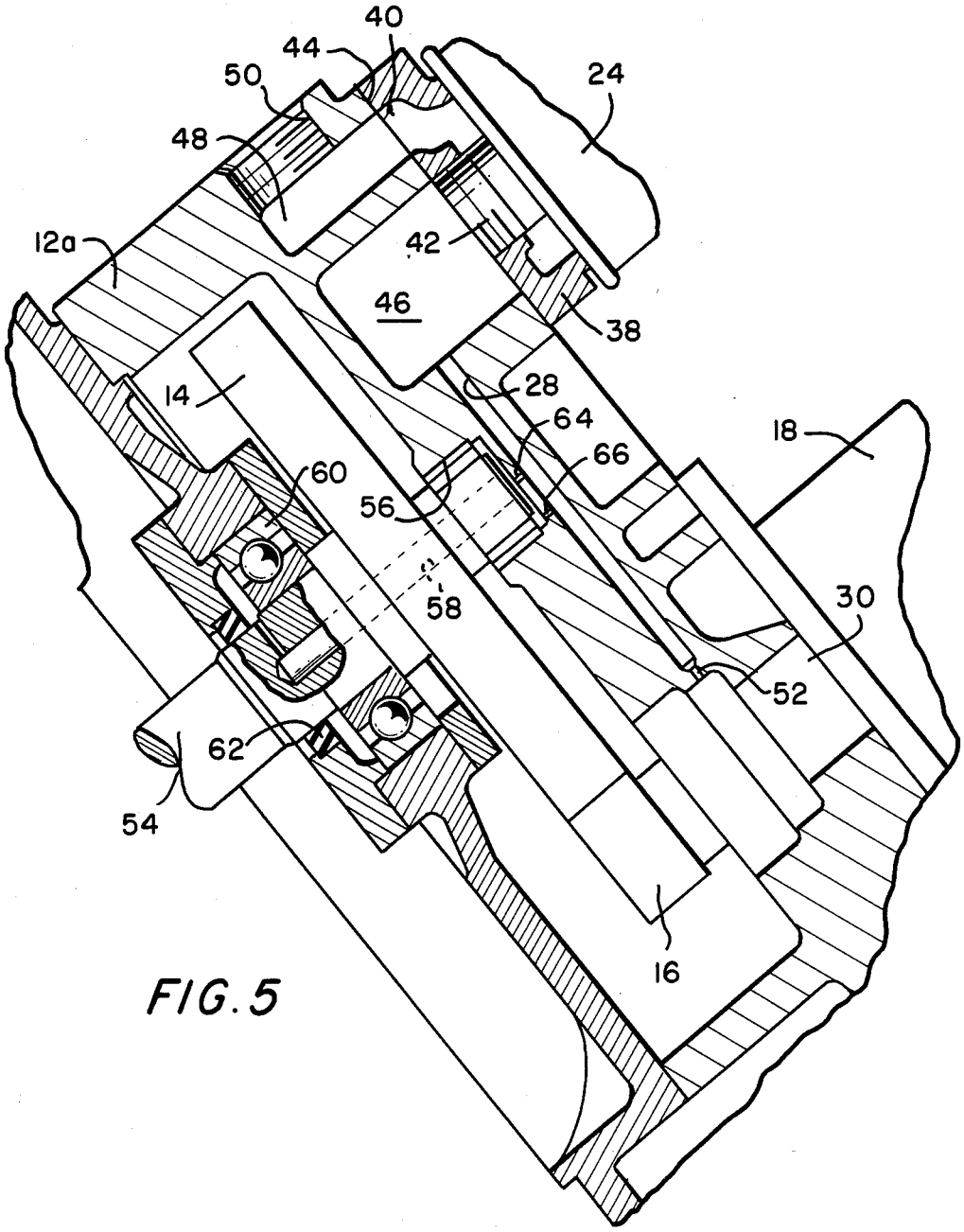
FIG. 5 is a cross-sectional view taken along section 5—5 of FIG. 3.

As can be seen in FIG. 5, an oil filter mounting plate 38, having a pair of ports 40 and 42 formed therethrough, is fixed to a boss 44 provided therefor on housing 12*a*. The passageway 28 in the housing 12*a* includes a pair of chambers 46 and 48 and the latter open onto the ports 40 and 42. An oil supplying port 50 opens onto chamber 48; accordingly, oil flow is from port 50, through chamber 48, through port 40 into the filter 24, out through port 42, into chamber 46, and then into the diagonal, downflowing straight portion of passageway 28. Passageway 28 opens through a metering orifice 52, at the lowermost end thereof, into journal 30.

Drive gear 14 is carried by a shaft 54 which has an end journalled in a recess 56 formed therefor in the housing 12*a*. The shaft 54 has an axial bore 58 formed therein to carry oil therethrough to a bearing 60 and seal 62 which are set thereabout. Two, further metering orifices 64 and 66, formed in housing 12*a*, communicate recess 56 with the passageway 28.

Ample lubrication is passed on to journal 32, from journal 30, via a channel 68 provided therefor, formed in the housing 12*a*, and opening at opposite ends onto journals 30 and 32. Too, excess oil is discharged from journal 32 via a channel 70.

While we have described our invention in connection with a specific embodiment, it is to be clearly understood that this is done only by way of example and not as a limitation to the scope of our invention as set forth in the objects thereof and in the appended claims.

What is claimed is:

1. In an air compressor having an airend with a pair of coacting rotors, a lubrication arrangement therefor, comprising:

a gear housing; and a pair of juxtaposed, coacting rotors;

said housing having means for rotatably journaling therein, on a horizontal plane, juxtaposed, ends of said rotors;

said housing further having a port formed therein for admitting lubricant thereinto;

said housing also having a confined passageway formed therein for conducting lubricant, which is admitted via said port, to said plane; and wherein said passageway is disposed at an inclination along a diagonal plane which traverses said horizontal plane.

2. A lubrication arrangement, according to claim 1, wherein:

said rotors journaling means comprises openings formed in said housing;

one of said openings receives an end of a male rotor therein;

said end of said male rotor carries a pinion gear thereon; and an end of said passageway opens onto said one opening for lubrication of said end of said male rotor.

3. In an air compressor having an airend with a pair of coacting rotors, a lubrication arrangement therefor, comprising:

a gear housing; and a pair of juxtaposed, coacting rotors;

said housing having means for rotatably journaling therein, on a horizontal plane, juxtaposed ends of said rotors;

said housing further having a port formed therein for admitting lubricant thereinto;

said housing also having a confined passageway formed therein for conducting lubricant, which is admitted via said port, to said plane; and wherein said passageway is disposed at an inclination along a diagonal plane which traverses said horizontal plane; and further including an oil filter mounting plate, fixed to said housing, said plate having (a) a pair of ports formed therein, and (b) a boss for mounting an oil filter thereupon; wherein said passageway comprises a pair of chambers; and said ports in said plate open directly onto said chambers.

4. In an air compressor having an airend with a pair of coacting rotors, a lubrication arrangement therefor, comprising:

a gear housing; and a pair of juxtaposed, coacting rotors;

said housing having means for rotatably journaling therein, on a horizontal plane, juxtaposed ends of said rotors;

said housing further having a port formed therein for admitting lubricant thereinto;

said housing also having a confined passageway formed therein for conducting lubricant, which is admitted via said port, to said plane; and wherein said passageway is disposed at an inclination along a diagonal plane which traverses said horizontal plane;

said housing further has a recess formed therein, in adjacency to said passageway, for journaling therein an end of a drive gear shaft; and said housing also has an orifice communicating said passageway with said recess.

5. In an air compressor having an airend with a pair of coacting rotors, a lubrication arrangement therefor, comprising:

a gear housing; and a pair of juxtaposed, coacting rotors;

said housing having means for rotatably journaling therein, on a horizontal plane, juxtaposed ends of said rotors;

said housing further having a port formed therein for admitting lubricant thereinto;

said housing also having a confined passageway formed therein for conducting lubricant, which is admitted via said port, to said plane; and wherein said passageway is disposed at an inclination along a diagonal plane which traverses said horizontal plane;

said housing further has (a) a recess formed therein, in adjacency to said passageway, for journaling therein an end of a drive gear shaft, and (b) a pair of orifices communicating said passageway with said recess.

6. In an air compressor having an airend with a pair of coacting rotors, a lubrication arrangement therefor, comprising:

a gear housing; and a pair of juxtaposed, coacting rotors;

said housing having means for rotatably journaling therein, on a horizontal plane, juxtaposed ends of said rotors;

said housing further having a port formed therein for admitting lubricant thereinto;

said housing also having a confined passageway formed therein for conducting lubricant, which is admitted via said port, to said plane; and wherein said passageway is disposed at an inclination along a diagonal plane which traverses said horizontal plane;

said rotors journaling means comprises openings formed in said housing;

one of said openings receives an end of a male rotor therein;

said end of said male rotor carries a pinion gear thereon;

an end of said passageway opens onto said one opening for lubrication of said end of said male rotor;

said openings comprise a pair of circular bores in which to nest bearings; and further including a channel, formed in said housing, communicating said bores with each other to accommodate lubricant flow therebetween from one of said bores to the other bore of said pair thereof.

7. An airend, for an air compressor, comprising:

a gear housing, of aluminum, die-cast formation;

said housing having substantially parallel, spaced-apart, side faces;

an oil filter mounting means, coupled to one of said faces, for mounting of an oil filter thereat;

a pair of coacting rotors;

a drive gear, and a therewith meshing driven gear, supported by said housing;

said driven gear being drivingly coupled to one of said rotors; wherein said other rotor is journalled in said housing outwardly, relative to said housing, and at a given side of said driven gear, in adjacency to a first, outermost end of the housing;

said one rotor is journalled in said housing inboard from said other rotor, i.e., inwardly, relative to said housing, and in juxtaposition with said other rotor;

said one rotor is of male, lobed, configuration, and said other rotor is of female, lobed configuration;

said other rotor has a given rotary axis; and an air inlet conduit, integral with said housing, disposed along a plane which traverses said axis.

8. An airend, for an air compressor, according to claim 7, wherein:

said oil filter mounting means is in adjacency to a second, outermost end of said housing which is opposite said first, outermost, housing end;

said mounting means and said one rotor have axial centers on a common plane; and said rotors also have axial centers on a common plane.

9. An airend, for an air compressor, according to claim 8, wherein:

said planes meet and mutually traverse at an axial center of one of said rotors.

10. An airend, for an air compressor, comprising:

a pair of coacting rotors; and a gear housing, of aluminum, die-cast formation, having means for journalling said rotors therewithin; wherein one of said rotors is a female rotor;

the other of said rotors is a male rotor;

said female rotor is journalled in said housing outwardly, relative to said housing, in adjacency to a first, outermost end of said housing and said male rotor is journalled in said housing inboard from said female rotor, i.e., inwardly relative to said housing, and in juxtaposition with said female rotor; and further including an air inlet conduit, integrally formed with said housing; wherein said female rotor has a rotary axis; and said conduit extends normal to said axis along a plane which substantially traverses said axis.

11. An airend, for an air compressor, according to claim 10, wherein:

said conduit has a prescribed inside diameter;

said female rotor has a given outside diameter; and said inside and outside diameters are substantially the same.

* * * * *